US005781159A

United States Patent [19]

Desargant

[11] Patent Number: 5,781,159

[45] Date of Patent: Jul. 14, 1998

[54] PLANAR ANTENNA WITH INTEGRAL IMPEDANCE MATCHING

[75] Inventor: Glenn J. Desargant, Brea, Calif.

[73] Assignee: Boeing North American, Inc., Seal Beach, Calif.

[21] Appl. No.: 721,496

[22] Filed: Sep. 27, 1996

[51] Int. Cl.[6] ..... H01Q 1/24; H01Q 1/38

[52] U.S. Cl. ..... 343/700 MS; 343/702; 343/749; 343/850

[58] Field of Search ..... 343/700 MS, 702, 343/749, 866, 867, 858, 850; H01Q 1/24, 1/38

[56] References Cited

U.S. PATENT DOCUMENTS 4,083,053 4/1978 Hall ..... 343/725
4,513,292 4/1985 Bowman ..... 343/795
4,777,490 10/1988 Sharma et al. ..... 343/700 MS
5,394,159 2/1995 Schneider et al. ..... 343/700 MS

*Primary Examiner*—Hoanganh T. Le
*Attorney, Agent, or Firm*—Tom Streeter

[57] ABSTRACT

Planar antennas 10*a*, 10*b* require impedance matching with their associated transceivers 20*a*, 20*b*. Conventionally, an inductance coil is placed between the transceiver 20*a*, 20*b* and the antenna 10. Such coils add loss, require space within the transciever, and increase costs. This invention replaces the inductance coil with a planar transmission line 18*a*, 18*b* within the planar antenna 10*a*, 10*b*, such as a co-planar line, slotline, or microstrip line. If desired, active circuits 30 may be applied across the transmission line 18*a*, 18*b*, with an RF choke 42 being used to allow a dc bias to drive the active circuits 30 while preventing interference with RF operation.

7 Claims, 2 Drawing Sheets

PLANAR ANTENNA WITH INTEGRAL IMPEDANCE MATCHING

BACKGROUND OF THE INVENTION

This invention relates to planar antennas and has particular relation to planar antennas without complex, discrete, impedance matching.

Planar antennas have been used for decades, especially in portable devices. An elongated strip of metal has a connector at one end, through which it passes signals to and from a radio transceiver. The strip is often partially crimped or rounded to provide partial rigidity without losing the ruggedness which comes from flexibility.

Electrically small antennas, such as most antennas on handheld transceivers, generally have a largely capacitive impedance. They therefore generally require impedance matching with their associated transceivers, the impedance for which is usually resistive, preferably fifty ohms. An inductance coil is therefore placed between the transceiver and the antenna. Such coils increase losses, require space within the transceiver, and increase cost, but are necessary to obtain impedance matching and efficient transceiver operation. Impedance matching coils are used for most if not all handheld transceiver antennas, planar and non-planar alike.

SUMMARY OF THE INVENTION

The present invention replaces the inductance coil leading to the antenna with a planar transmission line within the planar antenna, such as a co-planar line, slotline, or microstrip line. Planar transmission lines are well understood and may readily be designed for any desire, impedance. If desired active circuits may be applied across a transmission line, with an RF choke being used to allow a dc bias to drive the active circuit while preventing interference with RF operation.

DETAILED DESCRIPTION OF THE DRAWINGS

Figure 1A:
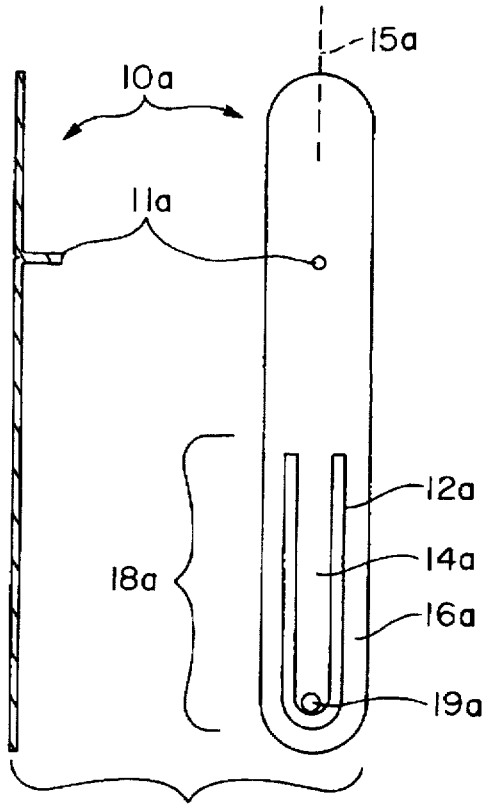
FIG. 1*a* and 1*b* are overall views of two implementations of the present invention.
Figure 1B:
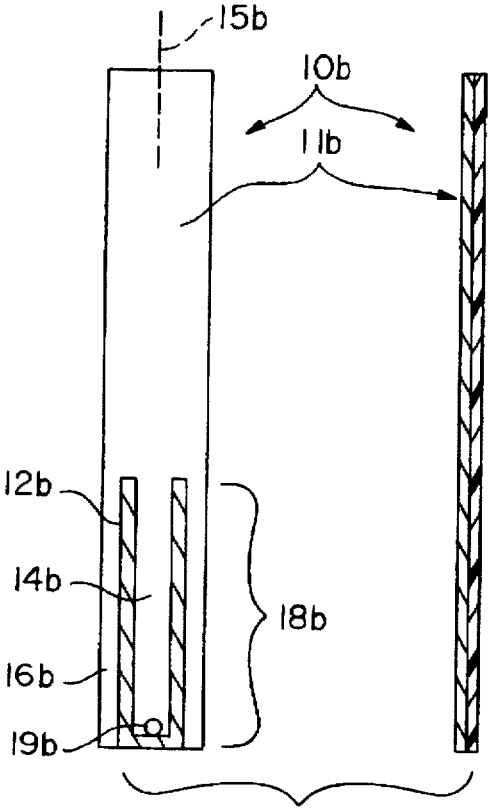

FIG. 1*a* and 1*b* are overall views of two implementations of the present invention. Figure 1*a* shows the metal version and FIG. 1*b* shows the metallized plastic version. In FIG. 1*a*, the metal planar antenna 10*a* includes an elongated metal strip 11*a* with parallel line cutout sections 12*a*. The inner 14*a* and outer 16*a* portions of each cutout section 12*a* forms the planar transmission line matching section 18*a* and the input 19*a* to the planar antenna 10*a*. Antenna 10*a* has an axis 15*a*. In FIG. 1*b*, the metallized plastic planar antenna 10*b* includes an elongated strip of dielectric 11*b*, with a metallic surface on one or both faces with parallel line cutout sections 12*b*. The inner 14*b* and outer 16*b* portions of the cutout section 12*b* forms the planar transmission line matching section 18*b* and the input 19*b* to the planar antenna 10*b*. Antenna 10*b* has an axis 15b. The transmission line or lines within this section 18*b* may be co-planar waveguides, co-planar strips, slotlines, microstrip lines, or any other transmission line (or combination thereof) suited to the application at hand. A good discussion of transmission lines appears in *Microstrip Lines and Slotlines*, by K. C. Gupta, Ramaesh Garg, and I. J. Bahl (Artech House, Norwood, Mass. 1979), the disclosure of which is incorporated herein by reference.

Figure 2:
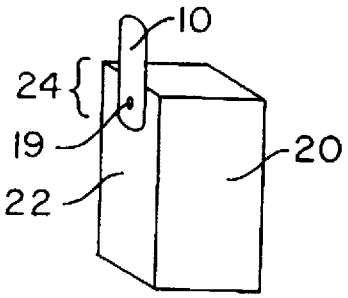
FIG. 2 shows the antenna of FIG. 1 side-mounted to its transceiver.

The antennas 10*a*, 10*b* of FIGS. 1*a*, 1*b* shows their transmission line sections 14*a*, 14*b* as being no wider than the remainder of the antenna 10*a*, 10*b*. This is suitable for antennas 10 which are to be side-mounted to their transceivers 20, as is shown in FIG. 2. Capacitive coupling between the side 22 of the transceiver 20 and the portions 24 of the transmission line section 14 which are not directly connected to the connector 19 will provide an adequate signal return, since the area of these portions 24 is relatively large, and their separation from the transceiver side 22 is relatively small.

Figure 3:
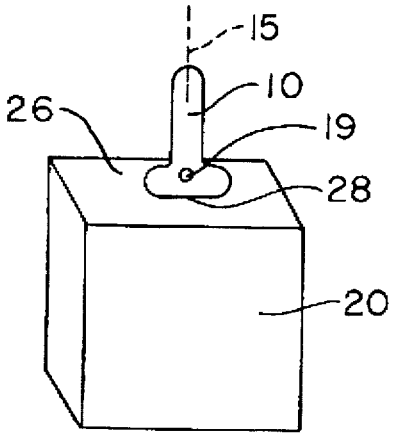
FIG. 3 shows a modified version of the antenna of FIG. 1, top-mounted to its transceiver.

The signal return will not be adequate if the antenna 10 is top-mounted, as shown in FIG. 3. The top surface 26 of the transceiver 20 acts as a counterpoise 26 for the antenna, but the base 28 of the antenna 10 is only a short line, and therefore has only a small effective area. Lengthening the line, that is, broadening the base 28, provides the necessary area. In such situations, the transmission line section 14 should include a broadened section 28 for coupling to the counterpoise 26. This is particularly true when the counterpoise 26 has a plane perpendicular to the axis 15 of the antenna 10.

Figure 4:
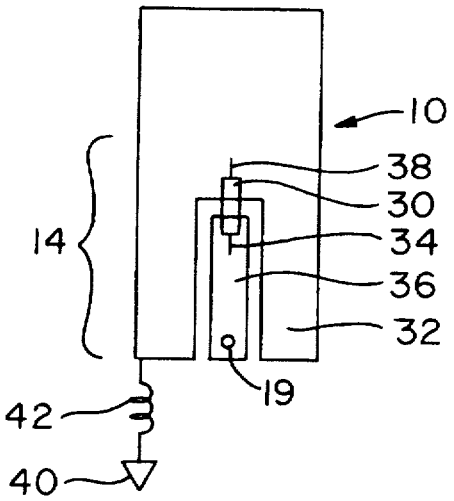
FIG. 4 shows an active circuit within or on the transmission line section.

FIG. 4 shows an active circuit 30 within or on the transmission line section 14. Additional active circuits 30 may be provided if desired. Active circuits 30 are possible if, as often happens, there are portions 32 of the transmission line section 14 which are isolated from the connector 19 and grounded. A bias applied to the connector 19 will then drive each active circuit 30, a first lead 34 of which is attached to a first portion of the transmission line section 14 which is attached to the connector 19, and a second lead 38 of which is attached to the second portion 32 of the transmission line section 14 which is grounded 40. To the extent that this second portion 32 is intended to be isolated from the RF signal on the connector 18, it must be grounded through an RF choke 42. This choke 42 may be a conventional-appearing inductance coil in the transceiver, but the inductance will take a most unconventional value. Instead of being selected to match the inductance of the transceiver over the RF band of interest, it is selected to block RF in this band.

Figure 5:
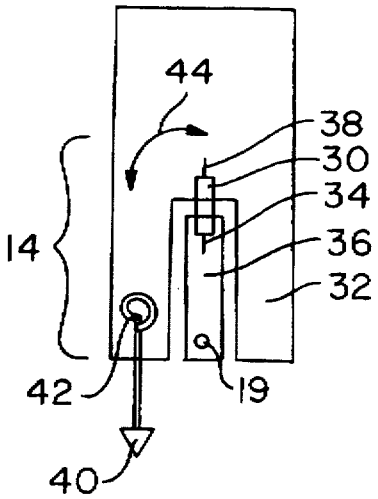
FIG. 5 shows an alternative location for the RF choke.

FIG. 5 shows an alternative location for the RF choke 42: within or on the transmission line section 14 itself. It may lie anywhere in a power supply loop 44 driving the active circuits 30. Its only requirements are that it be situated and constructed to simultaneously: (a) allow a dc bias to be applied to the active circuit 30; and (b) prevent RF from escaping from or into the power supply loop 44.

Radio transceivers 22, such as those shown in FIGS. 2 and 3, may therefore be constructed to omit the undesirable matching coil of the prior art.

SCOPE OF THE INVENTION

While several embodiments have been described in some detail, the true scope and spirit of the present invention is not limited thereto, but is limited only by the appended claims and their equivalents.

What is claimed is:

1. An article of manufacture comprising:

(a) a planar antenna having an elongated axis;

(b) a planar transmission line matching section within the planar antenna; and (c) an active circuit within or on the transmission line matching section; and (d) a counterpoise external to the planar antenna and adjacent to the transmission line matching section;

wherein the transmission line matching section includes a broadened section for capacitively coupling to the counterpoise, the counterpoise having a plane perpendicular to the axis of the antenna, the article of manufacture further comprising an RF choke within or on the transmission line matching section, in a power supply loop driving the active circuit, the RF choke being situated and constructed to simultaneously:

(1) allow a dc bias to be applied to the active circuits; and (2) prevent RF from escaping from or into the power supply loop.

2. A combination comprising:

(a) a radio transceiver; and (b) an article of manufacture comprising:

(1) a planar antenna having an elongated axis;

(2) a planar transmission line matching section within the planar antenna; and (3) a counterpoise included within a top or side of the transceiver, external to the planar antenna and adjacent to the transmission line matching section;

the transceiver being directly connected to an inner portion of the transmission line matching section by a connector, and the counterpoise being capacitively connected to an outer portion of the transmission line matching section.

3. The combination of claim 2, wherein the transmission line matching section includes a broadened section for capacitively coupling to the counterpoise, the counterpoise having a plane perpendicular to the axis of the antenna.

4. The combination of claim 3, further comprising an active circuit within or on the transmission line matching section.

5. The combination of claim 4, further comprising an RF choke within or on the transmission line matching section, in a power supply loop driving the active circuit, the RF choke being situated and constructed to simultaneously:

(a) allow a dc bias to be applied to the active circuits; and (b) prevent RF from escaping from or into the power supply loop.

6. The combination of claim 2, further comprising an active circuit within or on the transmission line matching section.

7. The combination of claim 6, further comprising an RF choke within or on the transmission line matching section, in a power supply loop driving the active circuit, the RF choke being situated and constructed to simultaneously:

(a) allow a dc bias to be applied to the active circuits; and (b) prevent RF from escaping from or into the power supply loop.

* * * * *